United States Patent [19]

Maurer et al.

[11] 4,151,628

[45] May 1, 1979

[54] CLEANER BOTTOM PLATE CONFIGURATION

[75] Inventors: Edgar A. Maurer; Donald B. Tschudy, both of Canton, Ohio

[73] Assignee: The Hoover Company, North Canton, Ohio

[21] Appl. No.: 890,250

[22] Filed: Mar. 27, 1978

[51] Int. Cl.[2] ..... A47L 9/02

[52] U.S. Cl. ..... 15/415 R

[58] Field of Search ..... 15/354, 355, 356, 357, 15/358, 359, 363, 366, 368, 372, 377, 383, 384, 391, 415 R

[56] References Cited

U.S. PATENT DOCUMENTS

| | | | |
|---|---|---|---|
| 2,601,697 | 7/1952 | Troxler | 15/356 |
| 3,071,799 | 1/1963 | Jepson et al. | 15/368 X |
| 3,120,021 | 2/1964 | Pauler et al. | 15/377 |

*Primary Examiner*—Christopher K. Moore

*Attorney, Agent, or Firm*—The Hoover Company

[57] ABSTRACT

A cleaner bottom plate is provided by a one piece molded configuration which includes an integral front sealing bead and a double flanged rear wall.

8 Claims, 6 Drawing Figures

CLEANER BOTTOM PLATE CONFIGURATION

BACKGROUND OF THE INVENTION

1. Field of the Invention

This invention relates to floor care appliances and, more particularly, relates to a one piece molded bottom plate for a cleaner nozzle.

2. Discussion of the Prior Art

Although bottom plates utilized to cover and obscure all but the nozzle opening for cleaner nozzles are old and well known, presently most of the conventional bottom plates take the form of a die cast plate or the like which has mounted on it a thin, peripheral elastic, compressible gasket, the same being disposed in a groove formed in the die casting for this purpose. This form of bottom plate is then attached to the nozzle or main casting proper by a buck toothed configuration found at the front of the bottom plate with tabs on the die casting to engage in small bracket formed by slots on the front of the nozzle or main casting.

Although such an arrangement provides the aforesaid shielding and also yields an effective seal, the use of a one piece molded bottom plate would provide advantages, namely, the reduction of parts required for the configuration, simplicity of design and economy. Such configurations are found as old in the art, and are exemplified by metal plate members which are rolled or formed to provide hook-like borders that mate over bulbous portions formed on the nozzle body. Such configurations as are known provide, presumably, a seal having some anti-leak integrity but at the same time the use of a hook configuration on the bottom plate requires either a thickened cross-sectional configuration for the bottom plate to lend strength or the use of a bottom plate material of high strength such as steel.

A molded bottom plate, especially one formed in plastic, is desired to contain minimum material and as such, the use of an integral reinforcing and sealing bead on this piece would stiffen this member without the use of a heavy cross section or resort to a high strength material.

It would therefore be advantageous to provide the bead and mating groove with a configuration which would engage in a tortuous manner to insure a good seal without any resort to a supplementary gasket or the like.

It would be additionally advantageous to provide a sealing arrangement for the rear of the bottom plate so that same was sealed to the nozzle substantially around its periphery.

It would be even more advantageous if the configuration of the rear seal for the bottom plate also contributed materially to the strength of this member.

It would still further be advantageous to provide guiding and blocking means with the bottom plate bead and mating groove that assured aligned interengagement between the two.

BRIEF DESCRIPTION OF THE INVENTION

The invention comprises a molded bottom plate having a configuration which imports integral sealing characteristics to it when mated with the agitator housing with which it serves. Its configuration also lends strength to its elongated flattened shape. More precisely, the bottom plate is made of a plastic such as polycarbonate that is easily moldable and includes an integral front bead element that acts as a forward seal and forward strengthening member. The bead is undercut so as to provide a more tortuous path to prevent leakage and to nestingly and pivotally mate with a groove shaped receiving means formed in the agitator housing.

The rearward side of the bottom plate includes a pair of upstanding flanged walls which receive therebetween a downwardly disposed flanged wall, integral with the agitator housing. The dual flanges again provide a tortuous seal and also serve as a rigidifying arrangement for the rear of the bottom plate. The outboard sides or ends of the bottom plate include rearwardly projecting leg members, one shortened abbreviated leg which serves to mask and protect the agitator housing rigid suction duct and the other an elongated leg serving as a belt protector. The bottom plate also includes a flange arrangement for the bearing and nesting reception of a rotatable agitator of generally conventional type. The agitator housing provides, in a conventional manner, the opposed bearing and nesting surfaces for the rotatable agitator.

The groove shaped receiving means is discontinuous, while the bottom plate includes tab portions adjacent the front bead so that tabs and discontinuities mate upon proper alignment between the groove and front bead.

BRIEF DESCRIPTION OF THE DRAWINGS

Reference may now be had to the accompanying drawings for a better understanding of the invention, both as to its organization and function, with the illustration being of a preferred embodiment, but being only exemplary, and in which.

DESCRIPTION OF THE INVENTION

Figure 1:
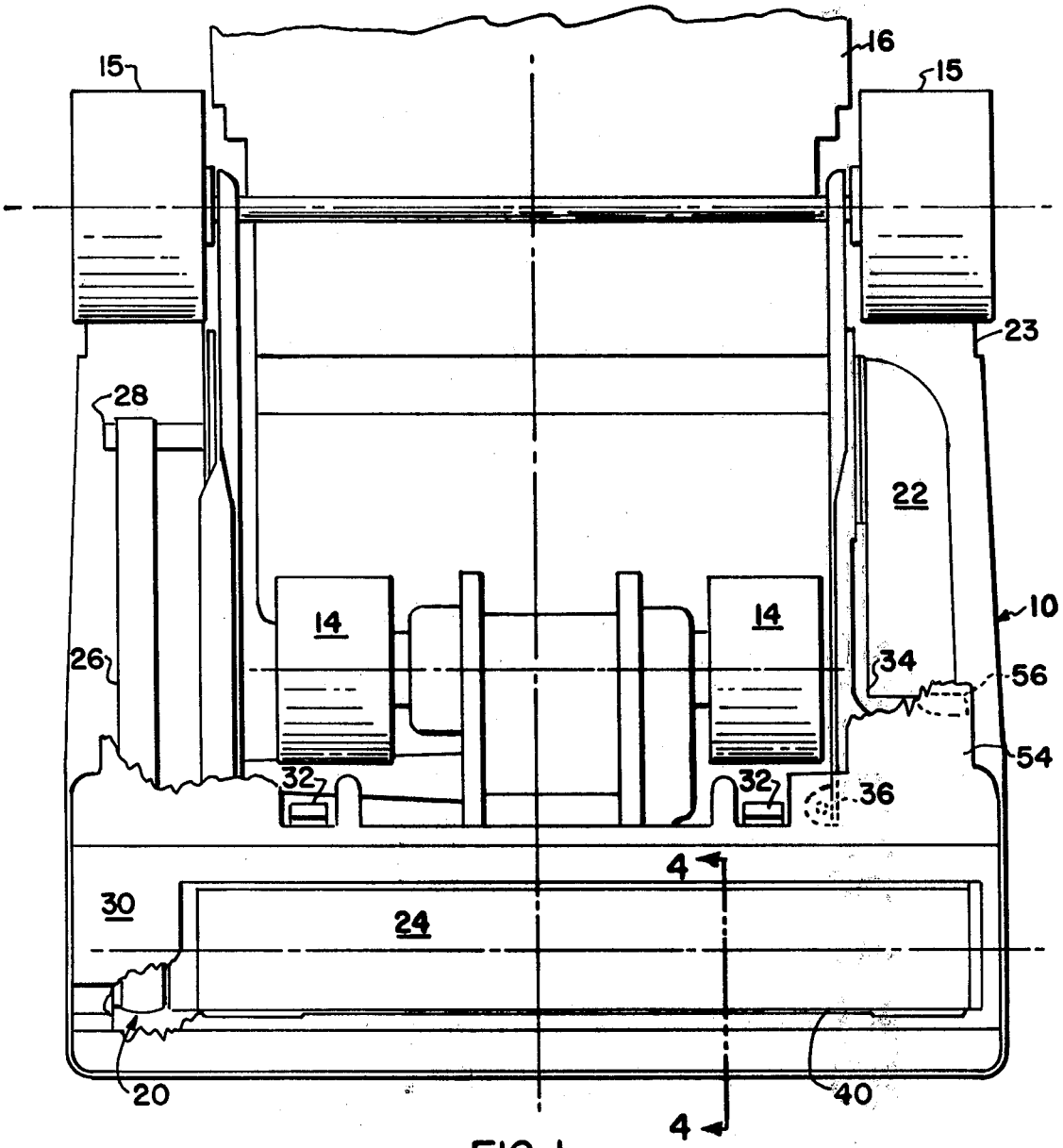
FIG. 1 is a bottom plan view of a nozzle housing of the invention with certain parts broken away.

Now referring more specifically to the drawings and with specific reference to FIG. 1, it can be seen that a nozzle assembly 10 includes tracking wheels 14, 14 and 15, 15, a motor-fan unit 12 and a dirt collecting bag 16. The motor-fan unit 12 and attached bag 16 are pivoted to the nozzle assembly in a manner similar to that shown in U.S. Pat. No. 3,581,591, owned by a common assignee.

A duct 22 extends forwardly from the motor-fan unit 12 so as to communicate with an agitator housing 20 that is attached by any conventional means to a housing 23 forming the periphery and outer surface of the nozzle assembly 10. Within the agitator housing 20 in an agitator chamber 21 is provided a substantially conventional rotating agitator 24 driven by a belt 26 trained over a pulley 28 which is fixed with respect to the shaft of the motor-fan unit 12. A nozzle opening closure plate 30, herein referred to as a bottom plate, is mounted over the open side of agitator housing 20 by a pair of engagement means 32, 32, such as pivoted spring catches that engage over rear portions of the bottom plate 30. In so far as related, the nozzle assembly 10 is generally conventional.

Agitator housing 20 of one piece molded configuration includes a connecting duct 34 which sealing attaches to duct 22 extending forwardly in the nozzle assembly 10. A conventional attachment means such as screws 36 (only one shown) are utilized for the attachment of the agitator housing 20 to the nozzle housing 23. The agitator housing includes a generally semi-cylindrical surface 38 to provide proper clearance for the rotating agitator 24 with the same, housed therein and extending through an aperture 40 in bottom plate 30. Agitator housing 20 also includes a welled flange 42 for the sealing and bearing reception of agitator 24 and an outer end wall 44 having a second well 46 into which the other end of the agitator is not rotatably received. The agitator end may be knurled (not shown), for example, to provide it with a non-rotary relationship with the second well 46. An opposite end wall 48 includes a third well 50 that receives an opposite shafted end of the rotating agitator 24.

The bottom plate 30 also of one piece molded configuration includes a pair of rearwardly extending arms 52, 54. The arm 52 is of a greater length than the arm 54 and extends rearwardly over the belt 26 (not shown) so as to shield the same from the rug or floor covering upon which the nozzle assembly 10 normally operates. The shorter arm 54 extends rearward to cover the fixed connecting duct 34 and its engagement with the duct 22. A gasket 56 attached to arm 54, adjacent its end, provides a seal for the lower terminations of the adjoining ends of the ducts 22, 34.

Figure 4:
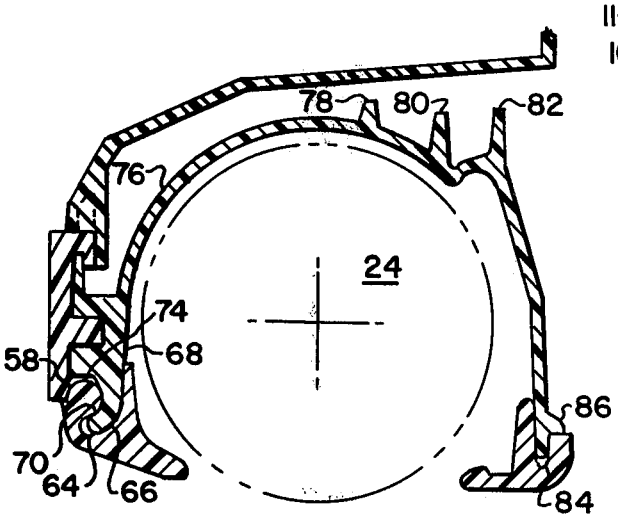
FIG. 4 is a vertical cross sectional view of the properly positioned, assembled bottom plate and agitator housing taken on line 4—4 of FIG. 1.

The method of generally maintaining and attaching the agitator housing 20 and bottom plate 30 together will now be detailed. The nozzle assembly 10 carries the agitator housing 20 therewith, as previously set out, with the lowest and forwardmost portions of agitator housing 20 including a series of discrete hook or open intermediate C-shaped portions or buck teeth 58, 58, 58, 58 and end C-shaped portions 60 and 60. These C-shaped portions have slight spaces or notches 62 therebetween. The discrete hook or open C-shaped portions 58 and 60 (FIG. 4) found at the forwardmost portions of the agitator housing 20 comprise a generally outwardly and slightly upwardly arcuately shaped hook, terminating in a round end 64 possessing an outer (disposed inwardly of the agitator housing) arcuate surface 66 which tangentially mates with a rear face of forwardmost wall 68 of the agitator housing 20 and on inner arcuate surface 70, whose center is identical to that of a bead-ball end 72 of the engaging bottom plate 30. Arcuate surface 70 merges with the forwardmost wall 68 of the agitator housing 22 through an upward and backward extending angular wall 74. Formed inner arcuate surface 70 does not mate with wall 68 tangentially to simplify the molding of the discrete hook or open C-shaped portions 58, 60.

The upwardly extending wall 68 takes a curvilinear configuration upwardly from the hooks 58 and 60, to furnish a thin walled vessel having the inner generally semi-cylindrical surface 38 and a generally corresponding outer surface 76. Integral upstanding ribs 78, 80 and 82 extend longitudinally along the outer surface of agitator housing 20 to serve so as to strengthen the same and rigidify its outline. The rearward continuation of agitator housing 20 extends downwardly to terminate in a tip 84 slightly below the lowermost portions of rounded tip 64.

Figure 2:
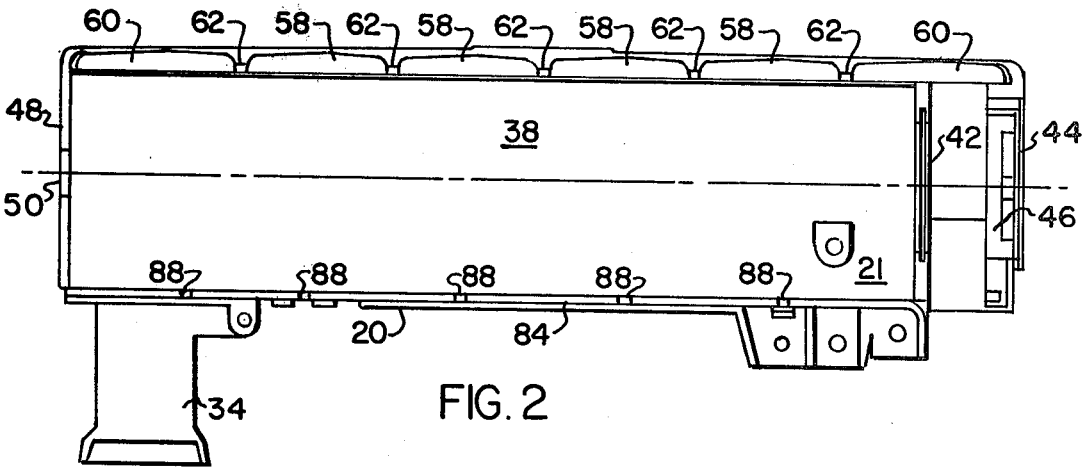
FIG. 2 is a bottom plan view of the agitator housing of the invention.

Tip 84 forms a flange wall for sealing the rearward portions of the agitator housing 20 to the bottom plate 30. In accordance with this function an integral horizontal rib 86 forms a flange or shelf which is disposed at the upper beginnings of the margins of tip 84 to provide an inward limiting means that the related portions of the bottom plate 30 will rest upon. As are hook portions 58, 58, 58, 58, 60 and 60, the tip 84 (FIG. 2) is also discontinuous providing a series of discon-tinuities or spaces 88 extending inwardly to the flange 86. The function of these discontinuities will be reviewed during the description of the bottom plate 30.

Figure 5:
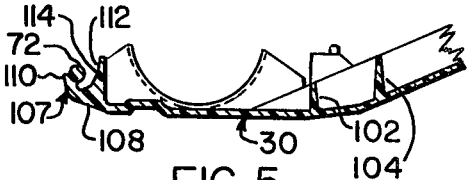
FIG. 5 is a vertical cross sectional view of the bottom plate of the invention taken on line 5—5 of FIG. 3.
Figure 3:
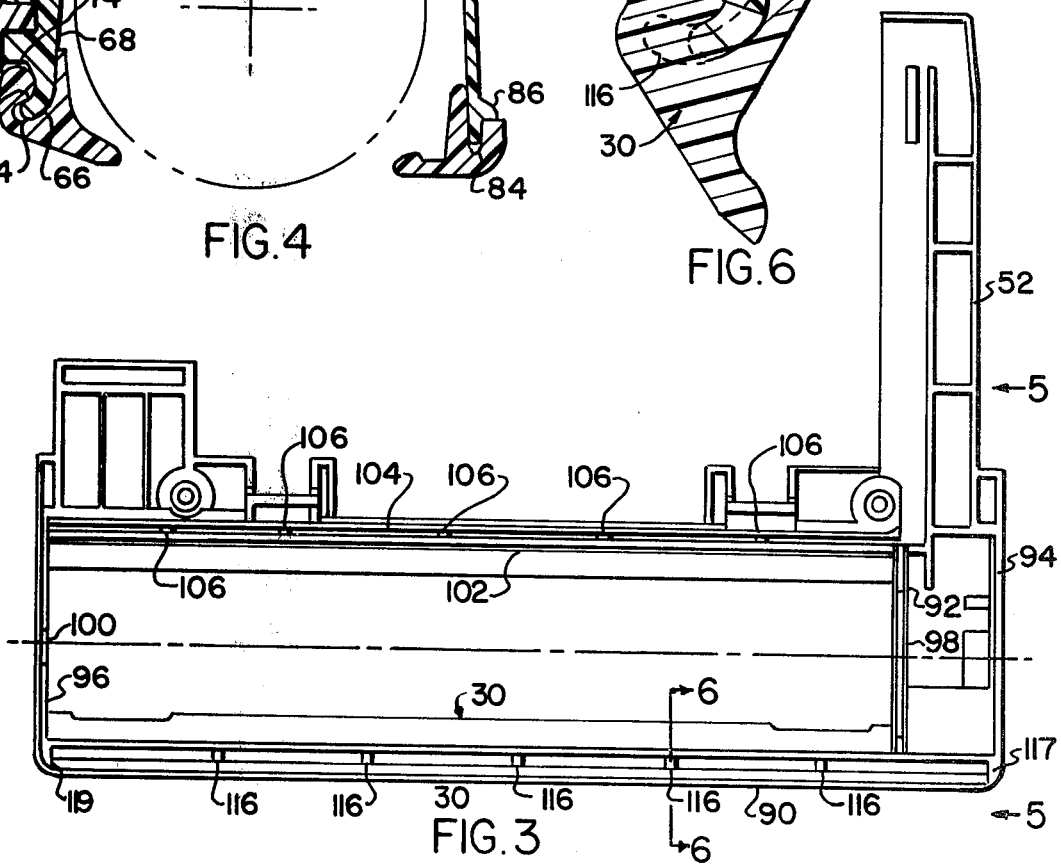
FIG. 3 is a bottom plan view of the bottom plate of the invention.

Turning now again to FIG. 3 and also FIG. 5, it can be seen that the bead or ball 72 extends substantially the whole way across a front face 90 of bottom plate 30. The bottom plate 30 is also bordered by upstanding transverse walls 92, 94 on its one end and an upstanding wall 96 on its other transverse end. These walls sealingly abut flange 42 and walls 44 and 48 of agitator housing 20, respectively, when the bottom plate 30 is mounted with agitator housing 20. Wall 92 includes a depression forming a well 98, like welled flange 42 to accommodate the agitator 24. Wall 96 also includes a well 100 for agitator retention purposes.

At its rear side, bottom plate 30 includes an upstanding wall or lip 102 and a spaced rear flange wall 104 of generally equal height. These two elements extend the length of the agitator chamber 21 and provide a means for trapping tip 84 of the agitator housing 20 between them to provide a tortuous rear seal between it and bottom plate 30.

Disposed between and transverse to these walls and integral with them are a series of reinforcing ribs 106, 106, 106, 106 and 106. These reinforce the walls 102, 104 and limit the requisite section thickness of the bottom plate 30 in its rear portions.

At its forward side bottom plate 30 includes integral bead 72. This bead is supported in position by an arm 107 that is undercut immediately past bead 72, at undercut portion 108, adjacent its merging with bead 72. This accommodates the tip or round end 68 of the hook portions 58 or 60. A sharp front edge 110 extends along the upper outer termination of arm 107 to provide a stylish appearance to this part of bottom plate 30.

The configuration of bead 72 and arm 107 is bordered inwardly by a wall or face 112 formed to taperingly mirror the concentricity of bead 72 and spaced from the bead and arm to form an annular groove 114 which has as its center of curvature the ball or bead 72. The groove 114 thereby easily, conformingly, receives the hook portions 58, 60 and permits the interengagement of the bead 72 with the hook portions 58, 60. At the same time, the generally, undercut relationship of the groove 114 and the relative extension of the hook portions supplies a tortuous seal at the front of the cleaner 10 with high leak integrity. The extent of the groove 114 and the undercut bead 72 also permit full pivoting or hinging of the bottom plate 30 against the agitator housing 20.

Figure 6:
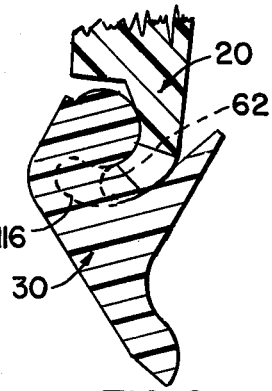
FIG. 6 is a cross sectional view of the partially interengaging blocking and guide means and taken generally on line 6—6 of FIG. 3.

The purpose of the discontinuities 62 between the C-shaped hook portions 58 and 60 will now become apparent. The wall 112 and arm 107 of bottom plate 30 are generally spaced from each other along their lengths. Short ribs or tabs 116, 116, 116, 116 and 116 are disposed so as to extend between these two elements and to be joined integrally to each. These ribs serve to strengthen the bead 72, without resort to a heavy mold section but they also, acting as guiding tabs, in conjunction with the notches 62, act as an inboard blocking and guiding means for the insertion and rotation of the bead 72 of bottom plate 30 within the hook portions 58 and 60. Thus, proper transverse alignment of the bottom plate 30 with the agitator housing 20 also aligns the notches 62 and ribs 116 to permit a guided aligned pivotal or hinging movement as the ribs 116 move within the notches or discontinuities 62. Of course, misalignment between the ribs 116 and notches 62 blocks proper assembly of the bottom plate and agitator housing. But proper insertion between them causes a telescoping of the ribs 116 (FIG. 6) in the notches 62 until the bottom plate 30 and agitator housing 20 are nestingly asembled with the bead and hook shaped portions engaged. Outer alignment and guidance tabs 117 and 119 (outboard) also aid in initial and final alignment.

The operation of the invention now should be clear. In order to assemble the bottom plate 30 to the agitator housing 20, with the bottom plate 30 disposed at substantially a right angle to the agitator housing, the bead 72 is inserted into hook portions 58 and 60 with the notches 62 aligned with the ribs 116. This insures that the bottom plate has not been canted. The bottom plate 30 is then fully rotated against the agitator housing 20 fully seating the undercut bead into the hook portions, and vice versa, guiding movement being provided by the ribs and notches. Final seating of the bottom plate also places walls 102, 104 of the bottom plate on opposite sides of and in reception of tip 84 to seal the rear of the assemblage, the front being sealed by the interengagement of the bead and hook portions.

It should be clear from the foregoing that all the objects of the invention have been fulfilled and, further, it should be obvious that many modifications can obviously be made to the invention that will still fall within its spirit and purview.

What is claimed is:

1. A nozzle assembly for use in a floor care appliance, the combination including:

(a) an agitator housing portion for said nozzle assembly, (b) a bottom plate for said agitator housing portion, (c) said agitator housing portion including a hook shaped lip at its forwardmost portions extending generally along the length of said agitator housing, (d) said bottom plate including a bead extending along the length of said bottom plate and rotatably received in said hook shaped lip to final position forming a seal between said bottom plate and said agitator housing, and (e) means for blocking rotation of said bead to final position in said lip when said bead is improperly aligned with said lip.

2. The nozzle assembly set out in claim 1 wherein;

(a) said blocking means is in part carried by said agitator housing portion and in part by said bottom plate, and said blocking means and a guiding means for guiding said bead to final position in said lip disposed partly on said hook shaped lip and adjacent said bead and partially inboard their ends.

3. The nozzle assembly as set out in claim 2 wherein;

(a) the blocking and guiding means comprise open notches on said hook shaped lip on said agitator housing portion and guiding tabs adjacent said bead on said bottom plate.

4. The nozzle assembly as set out in claim 3 wherein;

(a) said tabs serve as reinforcing ribs by extending from said bead to a reinforcing wall extending parallel to said bead and spaced closely thereto.

5. The nozzle assembly as set out in claim 4 wherein;

(a) said bead is undercut to permit intrusion of said hook shape portion therebeneath, upon full assembly of said agitator housing portion with said bottom plate to thereby form a labyrinth seal.

6. The nozzle assembly set out in claim 4 wherein;

(a) said agitator housing portion and said bottom plate include rear walls, (b) one of said agitator housing portions and said bottom plate having a single rear wall, the other having a pair of rear walls, (c) said single rear wall inserting mounted between said pair of rear walls upon assembly of said agitator housing portion and said bottom plate to provide a labyrinth type seal for the rear jointure of the agitator housing portion and the bottom plate.

7. A nozzle assembly for use in a floor care appliance, the combination including;

(a) a one piece molded agitator housing having a longitudinally extending front lip formed to provide a hook shape in end view, (b) a one piece molded bottom plate having an integral longitudinally extending bead molded therein, (c) said bead being integrally mounted on an arm providing an undercut configuration to the integral bead, (d) a groove formed behind the bead, (e) said bead having a center of curvature and being generally uniformly curved, (f) said hook shape also having a similar center of curvature and being generally uniformly curved, (g) said bottom plate when assembled with said agitator housing having said integral bead in engagement with said hook shape, with said hook shape extending into said undercut area, (h) whereby a substantially airtight joint of labyrinth nature and a pivot joint of durable structure is formed along the interengaging bead and hook portion.

8. A nozzle assembly for use in a floor care appliance, the combination including;

(a) an agitator housing portion, (b) a molded integral one piece bottom plate, (c) hook shaped portions extending along the front longitudinal side of one of said agitator housing portion and said bottom plate, (d) a bead extending along the front longitudinal side of the other of said agitator housing portion and said bottom plate, (e) said bead being undercut to provide an extended arcuate groove in one of said agitator housing portion and said bottom plate, and (f) said hook shaped portion engaging with said bead for an extended area of it because of said undercut to permit full hinging and to form a labyrinth type seal between said agitator housing portion and said bottom plate.

* * * * *